US005100465A

United States Patent [19]

Abodishish et al.

[11] Patent Number: 5,100,465

[45] Date of Patent: Mar. 31, 1992

[54] PROCESS FOR PURIFYING ZIRCONIUM SPONGE

[75] Inventors: Hani A. M. Abodishish, Ogden; Lonnie S. Kimball, Hooper, both of Utah

[73] Assignee: Westinghouse Electric Corp., Pittsburgh, Pa.

[21] Appl. No.: 632,783

[22] Filed: Dec. 24, 1990

[51] Int. Cl.[5] ..... C22B 34/14

[52] U.S. Cl. ..... 75/618

[58] Field of Search ..... 75/612-618, 75/621

[56] References Cited

FOREIGN PATENT DOCUMENTS 1163800 3/1984 Canada ..... 75/612

*Primary Examiner*—Melvin J. Andrews

*Attorney, Agent, or Firm*—J. C. Valentine

[57] ABSTRACT

A zirconium sponge contaminated with unreacted magnesium and by-product magnesium which is produced as a regulus in a Kroll reduction process is purified by:

distilling the magnesium and magnesium chloride from the regulus at a temperature of above about 800° C. and at a pressure less than about 10 mmHg;

condensing the magnesium and the magnesium chloride;

backfilling the sysem with a gas; and recirculating the gas between a vessel containing the purified zirconium sponge and a condenser containing the magnesium and magnesium chloride.

In preferred practice, the recirculating gas is an inert gas such as argon or helium and the system is backfilled during the distillation step.

The zirconium sponge is purified in shorter times and adsorbs less impurities from the air in subsequent handling.

4 Claims, 1 Drawing Sheet

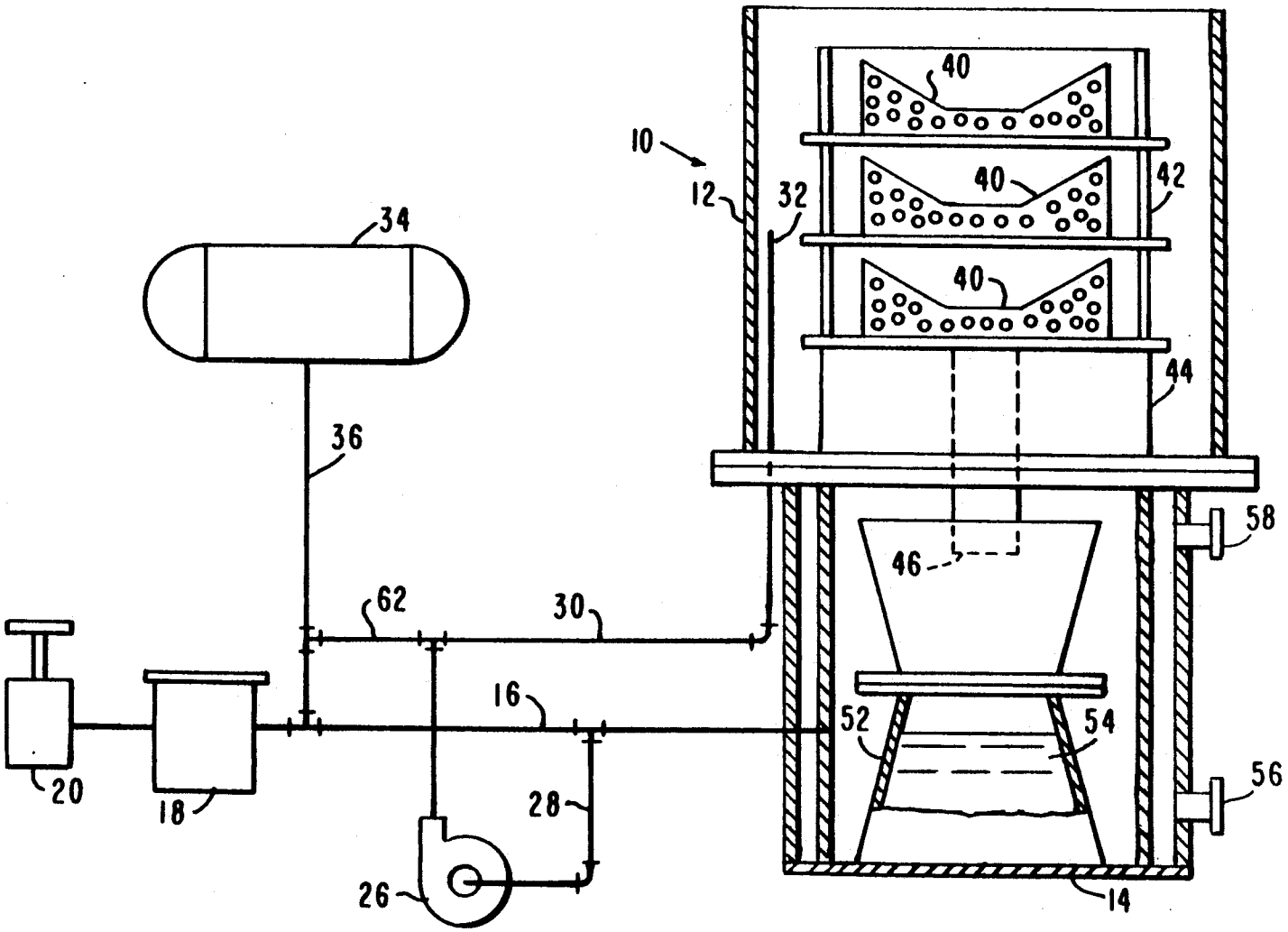
10
12
14
16
18
20
26
28
30
32
34
36
40
42
44
46
52
54
56
58
62

PROCESS FOR PURIFYING ZIRCONIUM SPONGE

This invention relates to a process for purifying a zirconium sponge produced in a Kroll reduction process.

In a Kroll process, zirconium chloride or a similar salt is reacted with magnesium to produce metallic zirconium and magnesium chloride. The zirconium is produced in a reduction retort in the form of a sponge contained in a regulus also containing the magnesium chloride and unreacted magnesium.

The regulus is transferred to a distillation unit to purify the zirconium sponge. The unit is first evacuated and the regulus degassed before being heated up to temperatures of above about 800° C. and while being maintained at absolute pressures of 10 mmHg or less. For example, the regulus may be maintained for 24 hours or more at a temperature between 800° C. and 1000° C. and at an absolute pressure of about 10 mmHg or less to distill the major portion of the magnesium. The regulus may then be maintained for another 24 hours or more at a temperature between 900° C. and 1100° C. and at an absolute pressure of about 100 micron Hg or less to distill off the major portion of the magnesium chloride.

In commercial processes, several zirconium sponges may be purified at a time. Several sponges may be placed in a distillation vessel. A removal box-type furnace then may be placed over the distillation vessel to heat the distillation vessel up to the process temperature and then to maintain the temperature for the duration of the step. After the magnesium and the magnesium chloride have been distilled from the sponge, the furnace may be removed and a cooling vessel then placed over the distillation vessel. Air may be blown through the annulus between the distillation vessel and the cooling vessel to cool the distillation vessel essentially by convection and radiation. The purified zirconium sponge cools essentially by radiation alone because it is maintained in a high vacuum until near the end of the cooling step when it will not react with atmospheric gases.

Thus the purification of a zirconium sponge requires a very long period of time, which results in a low throughput through the distillation unit.

SUMMARY OF THE INVENTION

It is an object of the present invention to purify a zirconium sponge at a substantially higher rate than is currently possible.

With this object in view, the present invention resides in an improved process for purifying a zirconium sponge contaminated with unreacted magnesium and magnesium chloride. In accordance with the invention, the magnesium and magnesium chloride are distilled from the zirconium sponge at a temperature above about 800° C. and at an absolute pressure less than about 100 micron Hg in a distillation vessel. The distilled vapors are condensed in a condenser disposed in gas-flow communication with the distillation vessel. The distillation vessel and the condensers are then backfilled with an inert gas such as helium. The gas is then recirculated between the distillation vessel and the condenser in order to cool the sponge from above about 800° C. to below about 300° C., and preferably to below about 100° C., by cooling the recirculating gas in the condenser. Preferably, the system is backfilled to an absolute pressure of about a half an atmosphere, which is sufficient to efficiently transfer substantial amounts of heat from the sponge to the condenser and to the cooled walls of the condenser while substantially suppressing the revaporization of the condensed magnesium and magnesium chloride.

In a preferred embodiment of the present invention, the system is backfilled with gas toward the end of the distillation cycle when low vapor pressure magnesium chloride is being distilled so that the inert gas acts as a carrier gas. Thus the distillation of magnesium chloride may proceed at higher absolute pressures and/or at higher rates than is currently possible. The cold gases will also quench or cool the sponge at a faster rate which eliminates the possibility of radiant heat from the sponge revaporizing a portion of magnesium or magnesium chloride. Revaporized vapors may back difuse to the pure sponges. This practice also reduces the time of the overall cycle which reduce cost.

DESCRIPTION OF THE DRAWING

The present invention will become more apparent from the following description of a preferred practice thereof, which may be practiced in the distillation unit schematically represented in the accompanying drawing.

DESCRIPTION OF A PREFERRED PRACTICE

The accompanying schematic generally shows a distillation unit 10 including an inverted distillation vessel 12 flanged to a condenser 14. Also shown is a large vacuum line 16 having an in-line filter 18 and an isolation valve 20 which connects the distillation unit 10 to a source of vacuum (which is not shown). The distillation unit 10 also includes an inert gas blower 26 having an inlet line 28 connected to the vacuum line 16 and an outlet line 30 connected to a distributor pipe 32 disposed in the distillation vessel 12 for recirculating an inert gas such as argon. The argon may be supplied to the distillation unit 10 from a storage tank 34 via line 36 or other suitable source of supply.

The distillation vessel 12 contains one or more, and shown as three, zirconium sponges 40 in frames 42 stacked on a base 44 having a downcomer 46 which extends into the condenser 14. The drawing generally shows the zirconium sponges 40 after the magnesium and magnesium chloride have been distilled off.

The condenser 14, as shown, has an hourglass-shaped crucible 52 containing condensed magnesium and magnesium chloride 54. The condenser may have a water-cooled jacket with an inlet 56 and outlet 58 or other suitable design.

In the practice of the present invention, the distillation vessel 12 is covered by a box furnace (not shown) and preheated to a temperature of about 400° C. while being evacuated to degas the system. The distillation vessel 12 and its contents are then heated to over about 800° C. and evacuated to an absolute pressure of about 100 mmHg or less to distill off the magnesium. The distillation vessel 12 is then heated to over about 900° C. to distill the magnesium chloride which has a vapor pressure that is about one-tenth of the vapor pressure of magnesium. The magnesium and the magnesium chloride flow through the downcomer 46 and condense in the hourglass-shaped crucible 52 in the condenser 14.

In a preferred practice of the present invention, an inert gas such as argon is backfilled into the system from a storage tank 34 toward the end of the distillation step to carry the magnesium chloride being distilled from the zirconium sponge. Preferably the absolute pressure in the distillation vessel and in the condenser is maintained at about 10 mmHg or less so that excessive amounts of heat are not transferred out of the distillation vessel 12 by the carrier gas. Circulation of the gas and the vapors in the distillation vessel 12 and the condenser 14 may be induced by the condensation of magnesium chloride in the condenser 14 or a blower 26 may be employed.

After the magnesium and magnesium chloride have been distilled from the zirconium sponge, the furnace is removed from the distillation unit 10 and preferably replaced by the cooling vessel (not shown). The distillation vessel 12 is then air-cooled by blowing air through the annulus defined by the distillation vessel 12 and the cooling vessel (not shown). While the distillation vessel 12 is being cooled in the cooling vessel (not shown), the zirconium sponge 40 is cooled via convection and radiation by a recirculating gas such as argon or helium which is recirculated between the distillation vessel 12 and the condenser 14. Preferably, the gas is recirculated by the blower, but circulation may be induced by thermal convection. The gas is cooled by the sidewalls of the crucible 52 above the condensed magnesium and magnesium chloride 54 and by the condensed products themselves. Preferably, the system is backfilled to an absolute pressure of about a half atmosphere. At substantially lower absolute pressures, the cooling times tend to be extended and the condensed products may revaporize and then recondense in lines 28 and 30 or in the blower 26. At substantially higher pressures, the cooling times only increase incrementally.

After the zirconium sponge 40 has been cooled to below about 300° C. and preferably to below 100° C., the system may be evacuated by blowing the argon back to the storage tank 34 through a return line 62 to recover argon, and the system then backfilled with air. The zirconium sponge 40 and the condensed products 54 may then be further processed. Alternatively, the argon may be recovered in a recovery unit.

In addition to substantially reducing the time necessary to purify the zirconium sponge 40, the present practice results in the absorption of argon on the surfaces of the sponges so that the sponges absorb less impurities from the air when the distillation units are backfilled with air or opened to the atmosphere.

The drawing generally shows a distillation unit 10 wherein hot gases in the distillation vessel 12 flow downwardly into the condenser 14 and onto the surface of the magnesium and the magnesium chloride. In an alternative design, the flow is reversed so that the gas flow is from the condenser to the distillation vessel (not shown). In this alternative design, the gases are preferably cooled in a heat exchanger to an intermediate temperature sufficiently high that condensation does not occur in line but low enough to substantially prevent revaporization of the magnesium and the magnesium chloride in the condenser 14.

While the present invention has been described with specific reference to a practice presently contemplated to be the best mode of practicing the invention, it is to be understood that various changes may be made in adapting the invention to other practices without departing from the broader inventive concepts disclosed herein and comprehended by the following claims.

We claim:

1. In a Kroll reduction process wherein a zirconium sponge contaminated with unreacted magnesium and by-product magnesium chloride is produced as a regulus, a process for purifying the zirconium sponge, comprising the steps of:

distilling magnesium and magnesium chloride from: a regulus containing a zirconium sponge and magnesium and magnesium chloride at a temperature above about 800° C. and at an absolute pressure less than about 10 mmHg in a distillation vessel to purify the zirconium sponge;

condensing the magnesium and the magnesium chloride distilled from the zirconium sponge in a condenser; and then backfilling the vessel containing the zirconium sponge and the condenser containing the magnesium and the magnesium chloride with a gas;

recirculating the gas between the vessel and the condenser to cool the zirconium sponge from above about 800° C. to below about 300° C.; and cooling the recirculating gas in the condenser containing the condensed magnesium and the condensed magnesium chloride as the gas cools the zirconium sponge to below about 300° C.

2. The process of claim 1, wherein the vessel and the condenser are backfilled to a vacuum of about a half atmosphere.

3. The process of claim 1, wherein the vessel and the condenser are backfilled with an inert gas.

4. The process of claim 3, wherein the inert gas is argon.

* * * * *